US006892799B2

(12) United States Patent
Maydanik et al.

(10) Patent No.: US 6,892,799 B2
(45) Date of Patent: May 17, 2005

(54) EVAPORATION CHAMBER FOR A LOOP HEAT PIPE

(75) Inventors: Yury Folyevich Maydanik, Ekaterinburg (RU); Roman Grigoryevich Sudakov, Ekaterinburg (RU); Sergey Vasilyevich Vershinin, Ekaterinburg (RU)

(73) Assignee: Boris Revoldovich Sidorenko, Ekaterinburg (RU)

( * ) Notice: Subject to any disclaimer, the term of this patent is extended or adjusted under 35 U.S.C. 154(b) by 0 days.

(21) Appl. No.: 10/486,268

(22) PCT Filed: Aug. 5, 2002

(86) PCT No.: PCT/RU02/00372

§ 371 (c)(1),
(2), (4) Date: May 5, 2004

(87) PCT Pub. No.: WO03/014648

PCT Pub. Date: Feb. 20, 2003

(65) Prior Publication Data

US 2004/0206480 A1 Oct. 21, 2004

(30) Foreign Application Priority Data

Aug. 9, 2001 (RU) ..... 2001122610

(51) Int. Cl.[7] ..... F28D 15/00

(52) U.S. Cl. ..... 165/104.26; 165/41; 165/104.33; 361/700; 174/15.2; 257/715

(58) Field of Search ..... 165/104.26, 104.33, 165/104.21, 911, 80.4, 185; 361/700; 174/15.2; 257/714–716

(56) References Cited

U.S. PATENT DOCUMENTS

| | | | | | |
|---|---|---|---|---|---|
| 3,661,202 | A | * | 5/1972 | Moore, Jr. | 165/105 |
| 3,741,289 | A | * | 6/1973 | Moore | 165/32 |
| 3,754,594 | A | * | 8/1973 | Ferrell | 165/32 |
| 4,467,861 | A | * | 8/1984 | Kiseev et al. | 165/104.22 |
| 4,883,116 | A | * | 11/1989 | Seidenberg et al. | 165/104.26 |
| 4,890,668 | A | * | 1/1990 | Cima | 165/104.25 |
| 4,921,041 | A | * | 5/1990 | Akachi | 165/104.29 |
| 5,360,058 | A | | 11/1994 | Koeppl et al. | 165/104 |
| 5,944,092 | A | * | 8/1999 | Van Oost | 165/104.26 |
| 6,241,008 | B1 | * | 6/2001 | Dunbar | 165/104.26 |
| 6,450,132 | B1 | * | 9/2002 | Yao et al. | 122/366 |

FOREIGN PATENT DOCUMENTS

| | | |
|---|---|---|
| DE | 4222340 | 1/1994 |
| EP | 0364361 | 4/1990 |
| RU | 2098733 | 12/1997 |
| RU | 11318 | 9/1999 |
| RU | 2156425 | 9/2000 |
| SU | 1449825 | 1/1989 |

* cited by examiner

*Primary Examiner*—Terrell Mckinnon
(74) *Attorney, Agent, or Firm*—Jacobson Holman PLLC

(57) ABSTRACT

The invention relates to heat engineering, in particular to heat pipes and can be used for removing heat from miniature high-heat object, in particular elements of radiotechnical instruments and computers requiring efficient removal of heat and minimum dimensions of a cooling system, the aim of said invention is to increase the heat load of an evaporation chamber at a predetermined temperature and to reduce the dimensions thereof. The inventive evaporation chamber for a loop heat pipe comprises a body having a side and an end wall and a capillary-porous orifice provided with steam-outlet channels and arranged inside said chamber. Said steam-outlet channels are united with the aid of a steam header and disposed on the part of the orifice perimeter of the side of a heat sink. Said evaporation chamber is also provided with an asymmetric hold offset in a direction opposite with respect to the heat sink. The ends of the steam-outlet channels are embodiment in such a way that they are dead on one side thereof. The asymmetric hole is also embodiment in such a way that it is dead on the side thereof which is opposite to the dead ends of the steam-outlet channels, the steam header being formed by one wall of the body and the end of the orifice.

9 Claims, 3 Drawing Sheets

A–A

EVAPORATION CHAMBER FOR A LOOP HEAT PIPE

This is a nationalization of PCT/RU02/00372 filed Aug. 5, 2002 and published in Russian.

FIELD OF INVENTION

The invention relates to heat engineering, in particular to heat pipes, and may be used for heat removal from miniature heat-dense objects, in particular elements of radioelectronic devices and computers requiring effective heat removal within at minimum dimensions of a cooling system.

BACKGROUND OF INVENTION

Known is a reversible heat-transfer device [1] which comprises evaporating chambers consisting of a heated portion and a compensation cavity, each equipped with an internally-accommodated a capillary porous packing having a central blind channel and a system of vapor-removal channels on thermal contact surfaces that communicate with a vapor collector.

The drawback of such design is the fact that the possibilities for reducing the diameter of the evaporating chamber are considerably limited as the thickness of the layer of the packing separating its absorbing and evaporating surfaces should be sufficiently large to prevent vapor penetration and decrease parasitic heat flows into the compensation cavity. However, when the evaporating chamber diameter is reduced to 4–8 mm, the packing layer thickness decreases, such that it can no longer exhibit a sufficiently high thermal resistance to the heat flow that penetrates into the compensation cavity. As a result, the temperature and pressure difference between the evaporating and the absorbing surfaces of a packing becomes insufficient for providing circulation of the heat-transfer medium in a device.

Known an evaporating chamber of a loop heat pipe [2] which consists of a heated portion and a compensation cavity, and comprises a body with side and a end-face walls, an internally-accommodated a capillary porous packing that is adjacent to the inner lateral surface of the chamber having a central blind channel, whose length is limited by length of the compensation cavity, and a system of vapor-removal grooves on the inner thermal contact surface in the heated portion of the chamber.

Such evaporating chamber may have a sufficiently small diameter meeting the requirements of miniaturization, which is achieved by absence of a central channel in the packing, wich channel would extend deep into the heated portion. However, the conducted tests have shown that the same circumstance brings about drawbacks of such design, which are a low maximum heat load due to an high hydraulic pressure of a packing.

In terms of the set of essential features and the attained result, the art most pertinent to the invention is an evaporating chamber [3] comprising a body which includes a side and end-face walls and a capillary porous packing positioned therein and having vapor-removal channels tied together by a vapor collector and located on a part of the packing perimeter at the heat-supply side, and having an asymmetrical longitudinal opening shifted in the direction opposite to the heat-supply side, the end-faces of the vapor-removal channels on both sides being blind.

Such arrangement for replenishing the evaporating chamber with a heat-transfer medium is more efficient as it makes it possible to considerably reduce the pressure loss when a heat-transfer medium is filtered a capillary porous packing, and an increased thickness of the locking wall achieved by shifting the asymmetrical longitudinal opening in the direction opposite to heat-supply side decreases a value of parasitic heat flows penetrating into the compensation cavity.

A drawback of such design is a reduced heat load at a given operating temperature. This circumstance is caused by the fact that the packing has a through longitudinal opening, whose both ends communicate with the compensation cavity. Parasitic heat leakages into the compensation cavity thereby increase accordingly, as the packing has two locking layers disposed on at side of its both end-faces. Besides, the presence of two locking layers increases length of the evaporating chamber. Another drawback of such evaporating chamber is the fact that the vapor collector, to which the vapor line of a loop heat pipe is connected, is disposed on the chamber side surface, which circumstance also increases dimensions of, and makes the device arrangement on a cooled object more difficult.

DISCLOSURE OF INVENTION

The invention basically directed to solving is the problem of increasing the heat load of an evaporating chamber at a given operating temperature and reducing dimensions thereof.

Said object is to be achieved as follows: in the proposed evaporating chamber of a loop heat pipe comprising a body that includes side and end-face walls and a capillary porous packing accommodated therein and having vapor-removal channels tied together by a vapor collector and positioned on a part of the packing perimeter at the heat-supply side, and having an asymmetrical longitudinal opening shifted in the direction opposite to heat-supply side, end-faces of the vapor-removal channels being blind at one side, according to the invention the asymmetrical longitudinal opening is also implemented as being blind at the side opposite to the blind end faces of the vapor-removal channels, and the vapor collector is formed by one of the end-face walls of the body and the packing end-face.

Owing to the fact that the asymmetrical longitudinal opening in the capillary porous packing is blind, the device efficiency is improved as there is a decrease in parasitic heat leakages into the compensation cavity, which results in an increased heat load at a given operating temperature. Further, dimensions of the evaporating chamber diminish as this a design requires only one end-face locking layer of a capillary porous packing. This result in a decrease in the longitudinal dimension of the evaporating chamber, and the proposed arrangement of the vapor collector and the vapor-removal channels allows to connect the vapor line of a loop heat pipe to the end-face wall, which results in decreasing the transverse dimension and increasing possibilities to carry out a compact assembly in a miniature cooled object.

Besides, to improve the heat exchange efficiency and decrease the thermal resistance of a device, additional vapor-removal grooves may be made on the inner surface of the side wall of the body, for instance, in the form of azimuthal grooves.

For adaptation of the evaporating chamber to operation under the zero-g conditions, the capillary porous packing may consist of two parts: the main one that provides circulation of a heat-transfer medium during the device operation, and the additional one, located in the compensation cavity and intended for the holding of a heat-transfer medium until the device starts to operate.

Disposition of the condensate-line outlet in the asymmetrical longitudinal opening of the capillary porous packing ensures its replenishment with a heat-transfer medium, even if in the compensation cavity there is a vapor phase, which may impede passage of a working fluid through the asymmetrical longitudinal opening.

EMBODIMENTS OF THE INVENTION

Figure 1:
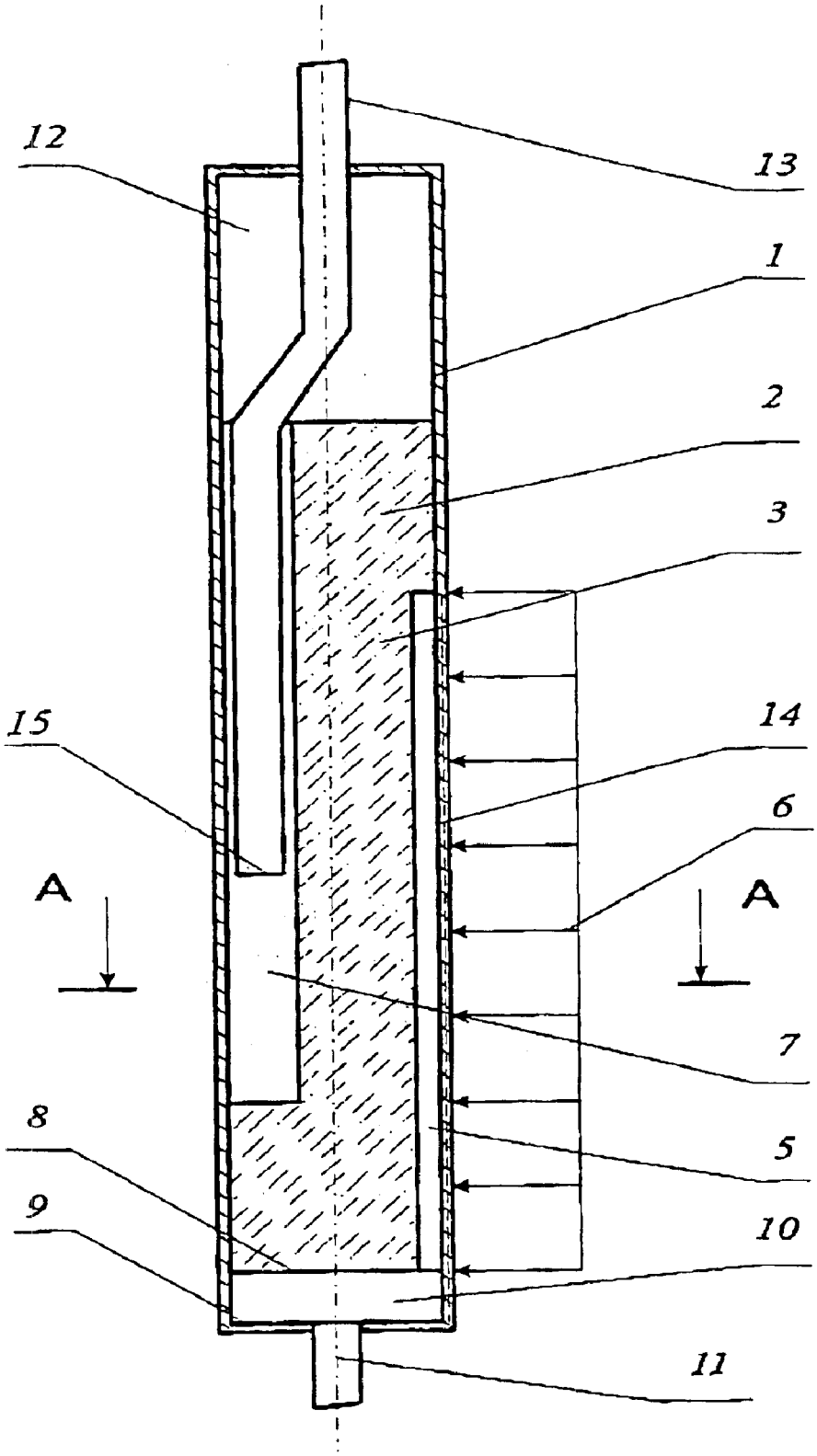
FIG. 1 presents the general view of an evaporating chamber of a loop heat pipe.
Figure 2:
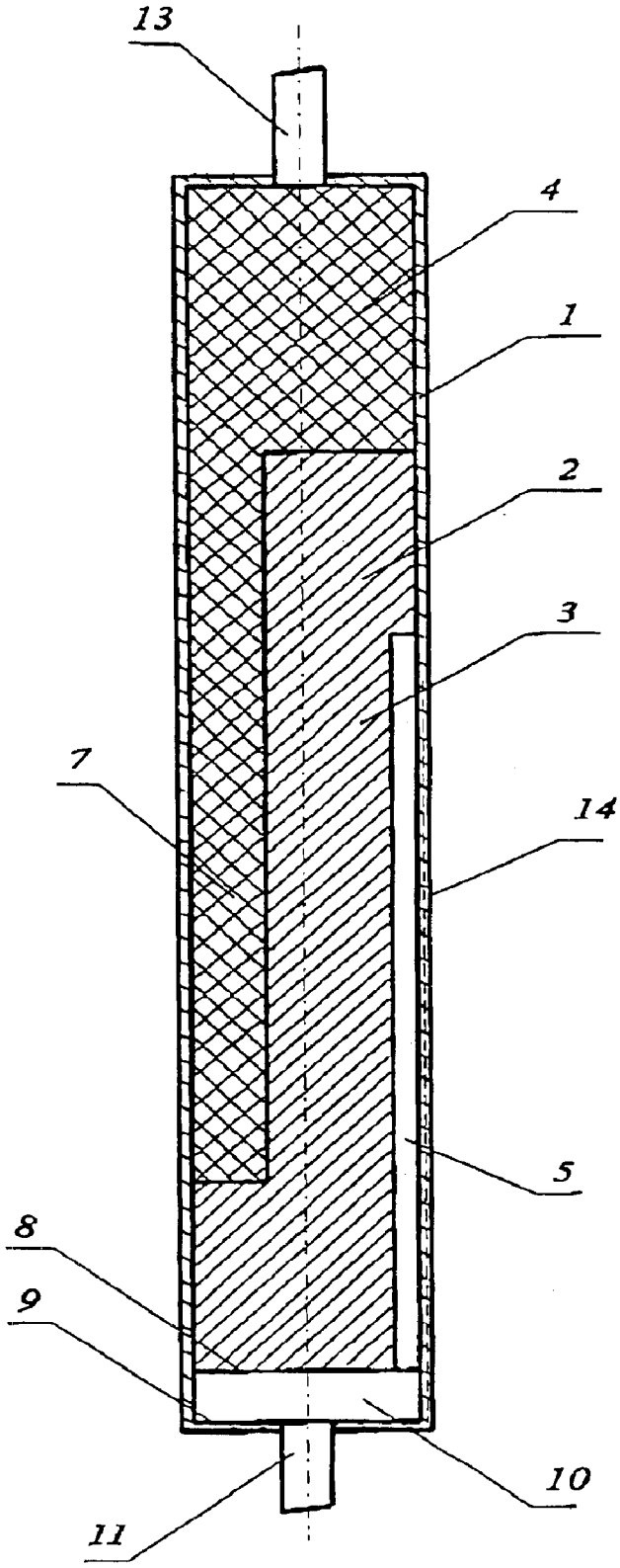
FIG. 2 gives a view of an evaporating chamber of a loop heat pipe with the main and the additional capillary porous packing.
Figure 3:
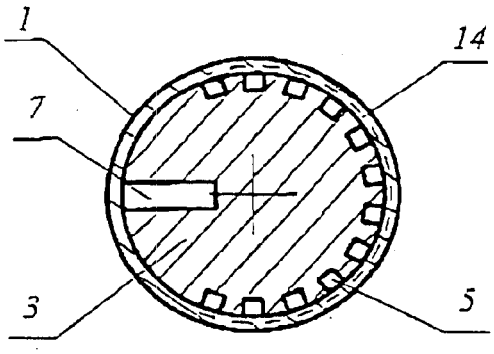
FIG. 3–7 show versions of the cross-section of the evaporating chamber.
Figure 4:
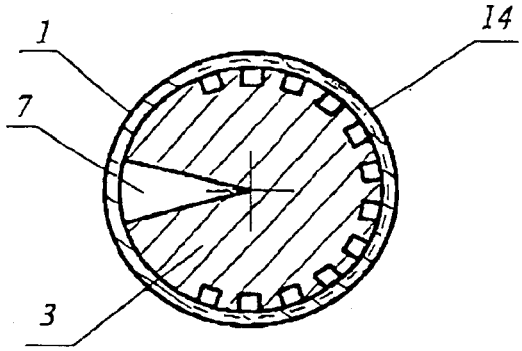

A form and the disposition of the replenishment asymmetrical channel may vary depending on required conditions for cooling a miniature heat-releasing object. Versions of the evaporating chamber, in which versions cross-section of the asymmetrical longitudinal opening has the form of a rectangle elongated in the direction of heat supply and limited on the opposite side by a body wall (FIG. 3), or the form of a wedge whose apex is directed to heat supply and whose base is a body wall (FIG. 4), ensure a sufficiently high heat load of the evaporating chamber. The form of a wedge is more preferable in the case that the heat load is distributed along a greater part of perimeter as such design ensures a higher thermal resistance to parasitic heat leakages into the compensation cavity.

Figure 5:
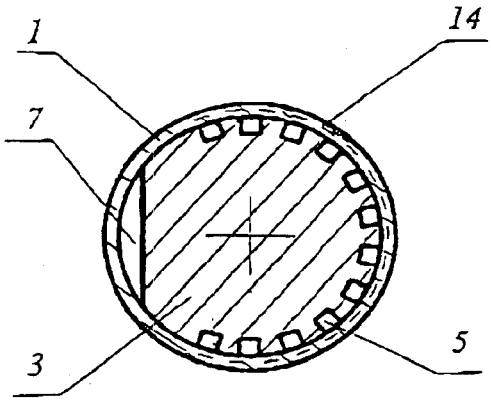

To reduce the start-up heat load, cross-section of the asymmetrical longitudinal opening may have the form of a segment whose chord is directed towards heat supply, and the arc is a body wall (FIG. 5). Such design ensures a sufficiently high thermal resistance of the capillary porous packing lager between the evaporating and absorbing surfaces, which circumstance is particularly important during start-up, when it is necessary to provide the maximum temperature difference between the vapor-generating surface of the packing and the compensation cavity.

Figure 6:
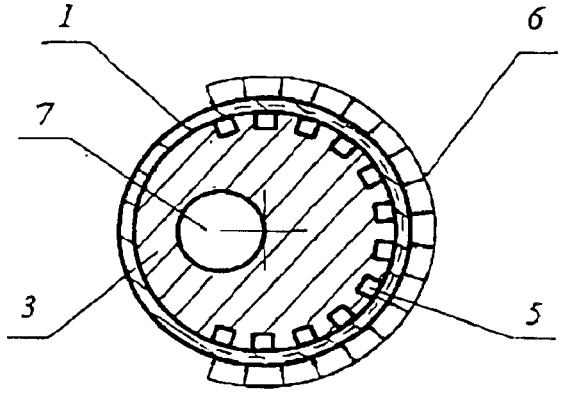

To prevent the vapor from leaking into the compensation cavity, cross-section of the asymmetrical longitudinal opening may have the form of a circle limited by the capillary porous packing, whose center is shifted in the direction opposite to heat supply (FIG. 6).

Figure 7:
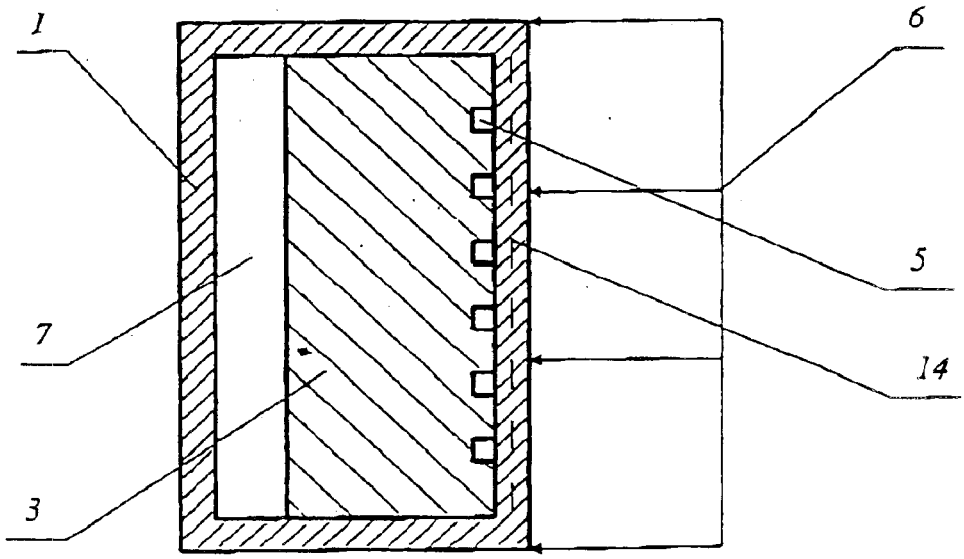

In the case that an object to be cooled has a flat thermal contact surface, cross-section of the evaporating chamber would be suitably rectangular, and the asymmetrical longitudinal opening having the form of a slot gap would be suitably shifted in the direction opposite to heat supply (FIG. 7).

The evaporating chamber of a loop heat pipe comprises a body 1 and a capillary porous packing 2 accommodated therein and which may consist of two parts: the main part 3 and the additional part 4, with vapor-removal channels 5 implemented on a portion of perimeter of the packing 3 at the side of heat supply 6 and an asymmetrical longitudinal opening 7, one end-face of which being blind. The space between the packing 8 end-face and the end-face wall of the body 9 defines the vapor collector 10 that ties together the vapor-removal channels 5 and is connected to the vapor line 11. The asymmetrical longitudinal opening 7, together with the volume 12 which is not occupied by the main packing 3 inside the body 1, form a compensation cavity, which has an outlet into the condensate line 13. On the thermal contact surface of the body 1 may have additional vapor-removal grooves 14, and the outlet 15 of the condensate line 13 may be implemented in the asymmetrical longitudinal opening 7.

THE EVAPORATING CHAMBER OPERATES AS FOLLOWS

In operation, the heat load supplied from an object to be cooled through the wall of the body 1 of the evaporating chamber is spent for evaporation of a heat-transfer medium, which is contained in pores in the liquid-vapor interface in the capillary porous packing 2 at the side of the heat supply 6. The resulting vapor is removed through a system of vapor-removal channels 5 and additional vapor-removal grooves 14 into the vapor collector 10. Through the vapor line 11, said vapor enters the compensation cavity (not shown in the drawing), where it condenses and gives heat to an outer heat sink. A shift of the asymmetrical longitudinal opening 7 in the direction opposite to heat-supply 6 side provides a sufficient thickness of the locking wall between the evaporating and absorbing surfaces of the packing 2, which prevents the vapor and parasitic heat flows from penetrating into the compensation cavity. This arrangement creates the required pressure difference between the condensation chamber and the compensation cavity, which difference ensures the return of a heat-transfer medium to the evaporating chamber, and also allows to achieve an increase in the heat load at a given operating temperature.

REFERENCES

1. RU Patent No. 2156425, F25D15/00, published 20 Sep. 2000.

2. Certificate of utility model No. 11318, F28D15/00, published 16 Sep. 1999.

3. USSR Inventor's Certificate No. 1449825, F28D15/02, published 7 Jan. 1989.

What is claimed is:

1. An evaporating chamber of a loop heat pipe, comprising a body that includes a side and an end-face walls and a capillary porous packing accommodated in said body and having vapor-removal channels tied together by a vapor collector and disposed on a portion of the packing perimeter at the heat-supply side, and also having an asymmetrical longitudinal opening shifted in the direction opposite to the heat-supply side, the end-face of the vapor-removal channels on one side being blind, characterized in that the asymmetrical longitudinal opening is implemented also as being blind at the side opposite to the blind end-faces of the vapor-removal channels, and the vapor collector is defined by one of the end-face walls of the body and the packing end-face.

2. The evaporating chamber according to claim 1 characterized in that additional vapor-removal grooves are provided on the inner lateral surface of the body.

3. The evaporating chamber according to claim 1 characterized in that the cross-section of the asymmetrical longitudinal opening has the form of a rectangle elongated towards the heat supply and limited at the opposite side by the body wall.

4. The evaporating chamber according to claim 1 characterized in that the cross-section of the asymmetrical longitudinal opening has the form of a wedge whose apex faces the heat supply, and whose base is the body wall.

5. The evaporating chamber according to claim 1 characterized in that cross-section of the asymmetrical longitudinal opening has the form of a segment whose chord faces the heat supply, and the arc is a body wall.

6. The evaporating chamber according to claim 1 characterized in that cross-section of the asymmetrical longitudinal opening has the form of a circle limited by a capillary porous packing and whose center is shifted in the direction opposite to the heat supply.

7. The evaporating chamber according to claim 1 characterized in that cross-section of the evaporating chamber is implemented as being rectangular, and the asymmetrical longitudinal opening, which has the form of a slot gap, is shifted in the direction opposite to the heat supply.

8. The evaporating chamber according to claim 1 characterized in that the capillary porous packing consists of two interconnected parts.

9. The evaporating chamber according to claim 1 characterized in that the outlet of the condensate line is positioned in the asymmetrical longitudinal opening of the capillary porous packing.

* * * * *